US006135022A

United States Patent [19]

Troester

[11] Patent Number: 6,135,022

[45] Date of Patent: Oct. 24, 2000

[54] LIGHTWEIGHT MARKING DEVICE

[76] Inventor: Thomas A. Troester, 172 Belleview Ave., Chillicothe, Ohio 45601

[21] Appl. No.: 09/150,453

[22] Filed: Sep. 9, 1998

Related U.S. Application Data

[60] Provisional application No. 60/058,233, Sep. 9, 1997.

[51] Int. Cl.[7] ..... B41J 2/22; B41J 2/23

[52] U.S. Cl. ..... 101/18; 101/3.1; 101/4; 400/124.01; 400/127; 400/132; 400/129

[58] Field of Search ..... 101/4, 18, 29, 101/3.1; 400/124.01, 127, 124.05, 124.11, 124.21, 124.23, 130, 131, 132, 129

[56] References Cited

U.S. PATENT DOCUMENTS

| | | | |
|---|---|---|---|
| 2,883,927 | 4/1959 | Egbert | 101/4 |
| 4,808,018 | 2/1989 | Robertson et al. | 400/121 |
| 4,898,485 | 2/1990 | Speicher | 400/128 |
| 5,316,397 | 5/1994 | Robertson et al. | 400/121 |
| 5,368,400 | 11/1994 | Cyphert et al. | 101/3.1 |
| 5,785,436 | 7/1998 | Harrison et al. | 400/124.01 |

*Primary Examiner*—John S. Hilten
*Assistant Examiner*—Daniel J. Colilla
*Attorney, Agent, or Firm*—James R. Eley; Arter & Hadden LLP

[57] ABSTRACT

Lightweight, programmable marking apparatus for moving a marking head to coordinate positions utilizing two fixed stepper motors performing in conjunction with a belt and pulley drive and cam drive systems. The dynamics of pneumatically driven marking pins within marking heads are accommodated for by dual guide rods mounted on marking base frame and material contacting standoffs. Improved marking head structure is provided utilizing a polyetherimide material and the use of an internal spring, rather than air pressure, to retract the marking pin to its top position. The lightweight design of the marking apparatus permits it to be adapted for hand held use.

20 Claims, 4 Drawing Sheets

LIGHTWEIGHT MARKING DEVICE

CROSS REFERENCE TO RELATED APPLICATIONS

This application claims the benefit of U.S. Provisional Application Serial No. 60/058,233, filed Sep. 9, 1997.

BACKGROUND

As industry has continued to refine and improve production techniques and procedures, corresponding requirements have been levied for placing identifying, data related markings upon components of manufactured assemblies. With such marking, the history of a product may be traced throughout the stages of its manufacture and components of complex machinery such as automobiles and the like may be identified, for example, in the course of investigations by quality control personnel or governmental authorities.

A variety of product marking approaches have been employed by industry. For example, paper tags or labels carrying bar codes may be applied to components in the course of their assembly. For many applications, such tags or labels will be lost or destroyed. Ink or paint spraying of codes such as dot matrix codes have been employed for many manufacturing processes. Where the production environment is too rigorous, however, or subsequent painting steps are involved, sprayed marks can be abraded or occluded and thus such an approach has been found to be unacceptable for certain applications.

The provision of a permanent or traceable marking upon hard surfaces such as metal traditionally has been achieved with marking punches utilizing dies which carry a collection of fully formed characters. These "full face dies" may be manually applied or positioned in a wheel or ball form of die carrier which is manipulated to define a necessarily short message as it is dynamically struck into the material to be marked. As is apparent, the necessarily complex mechanisms involved are prone to failure and full face dies exhibit rapid wear. Generally, the legibility and abrasion resistance of the resultant marks can be considered to be only fair in quality. Additionally, the marking punch approach is considered a poor performer in marking such surfaces as epoxy coatings and the like.

Laser activated marking systems have been employed. However, such systems are of relatively higher cost and the abrasion resistance and "readability after painting" characteristics of laser formed characters are considered somewhat poor and may be unacceptable in those applications where permanence is required.

More recently, industry has seen the development of programmable, dot peen marking devices for applying identifying marks on a wide variety of surfaces and components. U.S. Pat. No. 4,506,999 by Robertson, issued in 1985, entitled "Program Controlled Pin Matrix Embossing Apparatus" describes and claims a computer driven dot matrix marking technique which has been successful in the marketplace. This marking approach employs an array of tool steel punches which are uniquely driven using a pneumatic floating pin impact concept to generate man-readable and/or machine-readable dot characters or codes. Marketed under the trade designation PINSTAMP® by Telesis Technologies, Inc. of Circleville, Ohio, these devices carry the noted steel punches or "pins" in a head assembly which is moved relative to the workpiece being marked at selected skew angles to indent a dot or pixel defining permanent message or code into a surface. The system enjoys the advantage of providing characters of good legibility as well as permanence. Additionally, a capability for forming the messages or codes during forward or reverse head movements is realized. Use of the basic dot matrix character stamping device is limited, however, to piece parts which are both accessible by the head assembly and of adequate size.

Robertson, et al., in U.S. Pat. No. 4,808,018, entitled "Marking Apparatus with Matrix Defining Locus of Movement", issued Feb. 28, 1989, describes a dot matrix character impact marking apparatus which is capable of forming messages or arrays characters within a very confined region. With this device, a linear array of marker pins is moved by a carriage in a manner defining an undulating locus of movement. This locus traces the matrix within which character fonts are formed by the marker pins. The carriage and head containing the marker pins are pivotally driven by a cam to provide vertical movement and by a Geneva mechanism to provide horizontal movement. Pixel positions for the matrices are physically established in concert with pin or carriage locations by a timing disk and control over the pins is generated in conjunction with an interrupt/processor approach. Each marking pin of the pin array within the head assembly of this portable device is capable of marking more than one complete character for a given traverse of the head between its limits of moment.

Robertson, et al., in U.S. Pat. No. 5,015,106, issued May 14, 1991, and entitled "Marking Apparatus with Multiple Line Capability" describes a dot matrix character impact marking apparatus which achieves a multiple line capability wherein a carriage component carrying one or more marker pin cartridges moves within a singular plane locus of movement. This multiple line capability advantageously has permitted a broad variety of line configurations, for example in widely spaced positions at a workpiece. The device further employed a retrace method in generating a locus of marking movement somewhat similar to the formation of a raster in conjunction with television systems. A modular approach for the device was provided utilizing a forward housing carrying the locus defining component of the device which was then actuated from a rearwardly disposed motor containing housing component which served to drive cam assemblies at the forward portion. The carriage component of the device carried a manifold which, in turn, carried one or more marker pin cartridges, the pins of which were driven from an externally disposed valved and pressurized air supply. As before, the device performed in conjunction with a predetermined character defining matrix of pixel positions, each position of the matrix being identified to the system by a timing disk physically maneuvered with the drive components.

The success of the above products has led to further calls on the part of industry for even more compact marking systems of lower weight and higher rates of marking speed. Further, interest has developed in providing a broad range of marking capabilities for the type devices at hand. Robertson, et al., in U.S. Pat. No. 5,316,397, entitled "Marking Apparatus With Multiple Marking Modes", issued May 31, 1994, describes a matrix form of character marking utilizing a single plane undulatory motion of the pin cartridge carrying carriage, as well as a capability for the above-described raster form of locus of movement. This flexibility is achieved through the utilization of software changes as opposed to the insertion of hardware-based timing components and the like. The system disclosed exhibits a capability for full form character formation. This requires the actuation of the marker pins in a manner wherein discrete dots or pixels are not observable, the indentations formed by these pins being so closely nested as to evoke the image of a continuous line forming each character.

The floating pin impact concept initially introduced by Robertson has led to a variety of applications on the part of investigators. For example, in Cyphert, et al., U.S. Pat. No. 5,167,457, entitled "Apparatus and Method for Marking Arcuately Configured Character Strings", issued Dec. 1, 1992, and assigned in common herewith, the marking approach is adapted to the formation of character strings in arcuate fashion. Similarly, the approach was adapted to systems for marking the curved inner surface of pipes as described in U.S. Pat. No. 5,119,109, by Robertson, entitled "Method and Apparatus for Marking the Inside Surface of Pipes", issued Jun. 2, 1992, and assigned in common herewith.

The reading of dot matrix characters and codes following their formation may be carried out by a video based system described in U.S. Pat. No. 4,806,741, by Robertson, entitled "Electronic Code Enhancement for Code Readers", issued Feb. 21, 1989, and assigned in common herewith.

Certain marking applications of the floating pin impact concept call for the use of a single marking pin as opposed to an array of pins. Guidance of this form of single pin typically has been carried out utilizing robotic systems. Several such systems are currently marketed under the trade designations TMP3000™, TMP6000™ and IDENTI-PLATE® by Telesis Techologies, Inc., of Circleville, Ohio.

Investigators now are seeking to improve the performance of these marking systems in terms both of weight, speed, cost and dot or indentation quality. Speed of marking generally is constrained by the air pressure limits of solenoid actuated valves and delivery systems. Thus, enhancements of this operational parameter have been sought to be achieved with efficient valve actuation and improved pin-cartridge design. Dot quality aspects involve both the controlled depth of the dot formation, as well as proper positioning of the dot in the construction of character symbols and codes. Heretofore, the hardened steel pins employed with the arrays have been slidably mounted within chambers formed in steel or surface hardened aluminum cartridges. These cartridge chambers have been observed to wear, a condition leading to degrading pin marking performance. Lubrication for the rigorous pin dynamics involved has been through the introduction of lubricant into driving and return air functions of the system. Poor control over the amounts of such lubricant employed leads to undesirable variations in the quality of dot formation.

In general, the structures which have been heretofore developed have been of a somewhat robust nature in view of the forces involved in driving the pins into impact with a metal surface and the return of the pins. Of current interest, it has been apparent that it is desirable to expand the utilization of this form of marking to the manual identification of components of a broader variety of products. This calls for the development of marking systems which can be hand held and still retain the quality of marking heretofore achieved, but which are of lesser cost and, preferably, which are much lighter, notwithstanding the dynamics of character formation involved.

SUMMARY

The present invention is addressed to a marking apparatus of relatively light structure having the capability of accurately and rapidly positioning a marker head at coordinate defined locations within a marking field. Utilizing two, fixed motor drives, for example, of a d.c. stepper variety, the marking head is articulated by a system comprising a capstan, a drive belt, multiple pulleys and a cam arrangement, the drive belt being positively driven by a capturing capstan configuration at the rotational output of one of the two d.c. stepper motors. Accommodation of the relatively light apparatus to the rigorous dynamics associated with the impacting and rebounding of a pneumatically driven steel marker pin system is achieved through the utilization of parallel guide rods and material contacting standoffs.

Provided with the marking device drive is an improved, lightweight marking head component. Formed of polyetherimide material, the head structure exhibits adequate strength and a self-lubricating quality advantageously eliminating the need for introducing a lubricant into drive air feed. A spring return may utilized in lieu of return air pressure thus eliminating the need for a second pneumatic hose being routed to the marker. The weight reduction not only makes the marking apparatus more conducive to being hand held, it also eliminates the requirement to ramp up and ramp down the traverse speed of the head assembly to accommodate inertia and momentum.

Another feature of the invention is to provide an apparatus mountable with a support structure for marking a solid material surface with predetermined character-based information in response to control signals, comprising a base frame and a marking head drive frame having forward and rearward extents pivotally coupled at its rearward extent to the base frame and having first and second guide rods mounted in parallel adjacency at forward and rearward locations of the marking head drive frame.

A first motor assembly is mounted to the base frame, and has a rotational output coupled in driving relationship with the head carriage for effecting movement thereof in a first axis in response to control signals. A second motor assembly is mounted to the base frame, and has a rotational output coupled in driving relationship with the marking head drive frame for effecting movement thereof in a second axis in response to control signals.

A marking head carriage is provided having forward and rearward bearing surfaces slidably engaged with the first and second guide rods and having a head mounting component at its forwardmost extent. A marking head assembly is coupled with the head mounting component, the marking head assembly having a confronting portion positionable a predetermined distance from the material surface, a marking pin chamber within the head assembly, the chamber having a drive portion extending from a top position toward a seating surface and communicating with a shaft receiving portion extending from the seating surface toward an opening at the confronting portion. A marking pin positioned within the chamber has a piston portion of predetermined first diameter, movable by a driving force between a first position adjacent the top position and a second position toward the seating surface, and a shaft portion of predetermined second diameter depending from the piston portion extending to an indentation tip.

A driving force is configured to drive the marking pin with a force selected to form an indentation by the indentation tip in the solid material surface, while a biasing component within the head assembly, actuable between the seating surface and the piston portion of the marking pin urges the marking pin to return toward the top position when the driving force is removed.

Yet another feature of the invention is to provide a hand held marking apparatus for marking a solid material surface with predetermined character-based information in response to control signals, comprising a base frame and a marking head drive frame having forward and rearward extents pivotally coupled at its rearward extent to the base frame, and having first and second guide rods mounted in parallel adjacency at forward and rearward locations of the marking head drive frame.

A first motor assembly is mounted to the base frame, and has a rotational output coupled in driving relationship with the head carriage for effecting movement thereof in a first axis in response to control signals. A second motor assembly is mounted to the base frame, and has a rotational output coupled in driving relationship with the marking head drive frame for effecting movement thereof in a second axis in response to control signals.

A marking head carriage is provided having forward and rearward bearing surfaces slidably engaged with the first and second guide rods and having a head mounting component at its forwardmost extent. A marking head assembly is coupled with the head mounting component, the marking head assembly having a confronting portion positionable a predetermined distance from the material surface, a marking pin chamber within the head assembly, the chamber having a drive portion extending from a top position toward a seating surface and communicating with a shaft receiving portion extending from the seating surface toward an opening at the confronting portion.

At least one standoff is provided having a predetermined length, and extending from the base frame for contacting the solid material surface during marking for maintaining the confronting portion of the marking head assembly at a predetermined distance from the material surface. A gripping handle is connected to the base frame for manually positioning the marking apparatus with respect to the solid material surface and having a manually actuable switch in communication with the control signals for initiating a marking sequence.

A marking pin positioned within the chamber has a piston portion of predetermined first diameter, movable by a driving force between a first position adjacent the top position and a second position toward the seating surface, and a shaft portion of predetermined second diameter depending from the piston portion extending to an indentation tip.

A driving force is configured to drive the marking pin with a force selected to form an indentation by the indentation tip in the solid material surface, while a biasing component within the head assembly, actuable between the seating surface and the piston portion of the marking pin urges the marking pin to return toward the top position when the driving force is removed.

Other features of the invention will, in part, be obvious and will, in part, appear hereinafter. The invention, accordingly, comprises the apparatus providing the construction, combination of elements, and arrangement of parts which are exemplified in the following detailed disclosure. For a fuller understanding of the nature and objects of the invention, reference should be had to the following detailed description taken in connection with the accompanying drawings.

DETAILED DESCRIPTION

Figure 1:
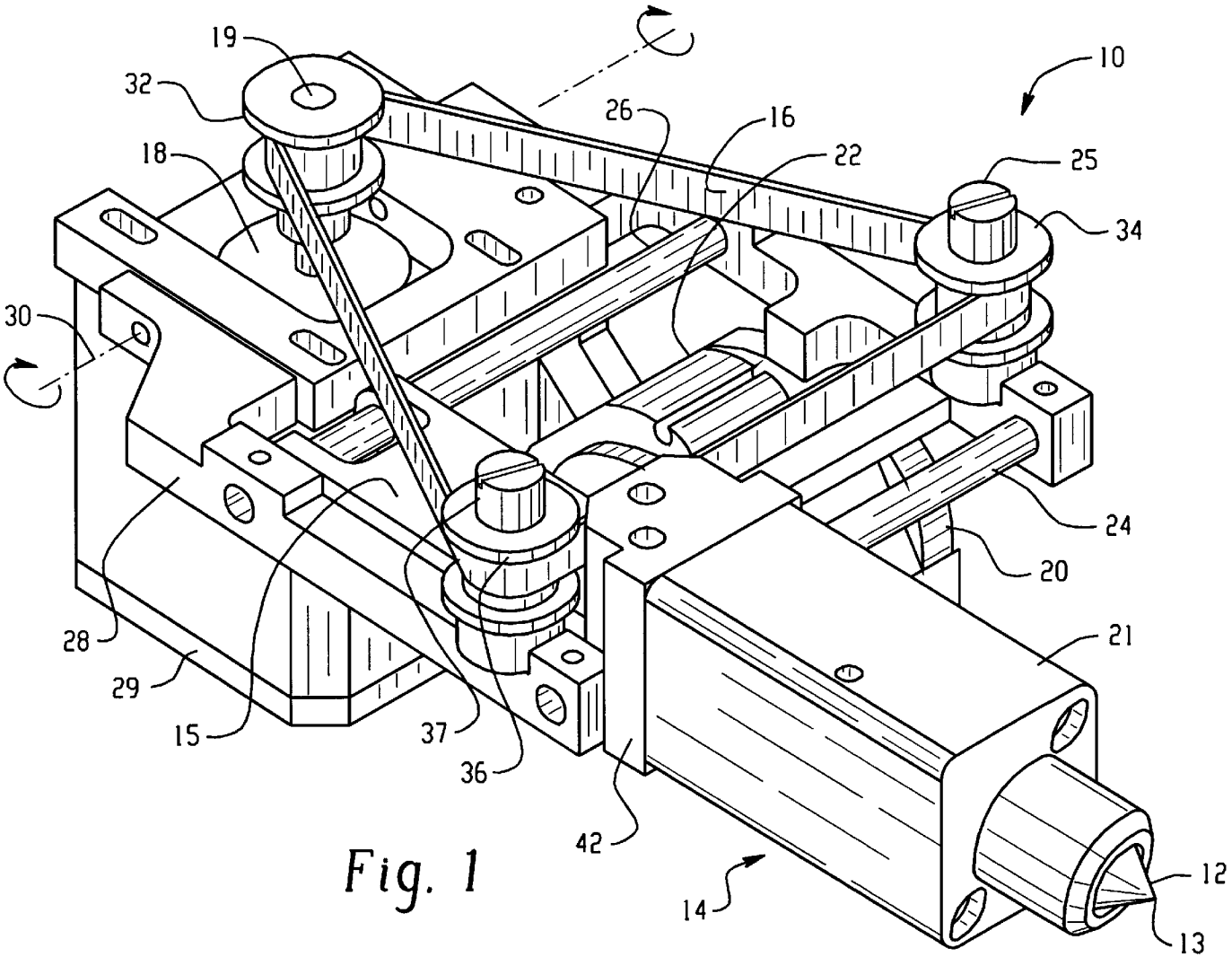
FIG. 1 is a front right side perspective view of the apparatus according to an embodiment of the invention.

Certain terminology may be employed in the description to follow for convenience rather than for any limiting purpose. For example, the terms "forward," "rearward," "right," "left," "upper," and "lower" designate directions in the drawings to which reference is made, with the terms "inward" and "outward" referring, respectively, to directions toward and away from the center of the referenced element. Terminology of similar import other than the words specifically mentioned above likewise is to be considered as being used for purposes of convenience rather than in any limiting sense.

For the purposes of the discourse to follow, the precepts of the marking system of the invention herein involved are described in connection with its utilization in connection with the permanent indentation-defined pixel marking of a solid material surface for its identification by a lightweight marking system. The marking device is configured to utilize either air pressure or an electric solenoid as its driving force at its marking head assembly to project the single marking pin at programmable intervals into the surface of a material, thus forming indentations at predetermined locations. The resulting indentations are effective to form characters, codes or other identifying graphic symbology in the surface of the solid material. It will be appreciated, however, that aspects of the present invention will find utility in connection with the marking of other such generally planar objects. The following description therefor should be construed as illustrative rather than limiting.

Figure 2:
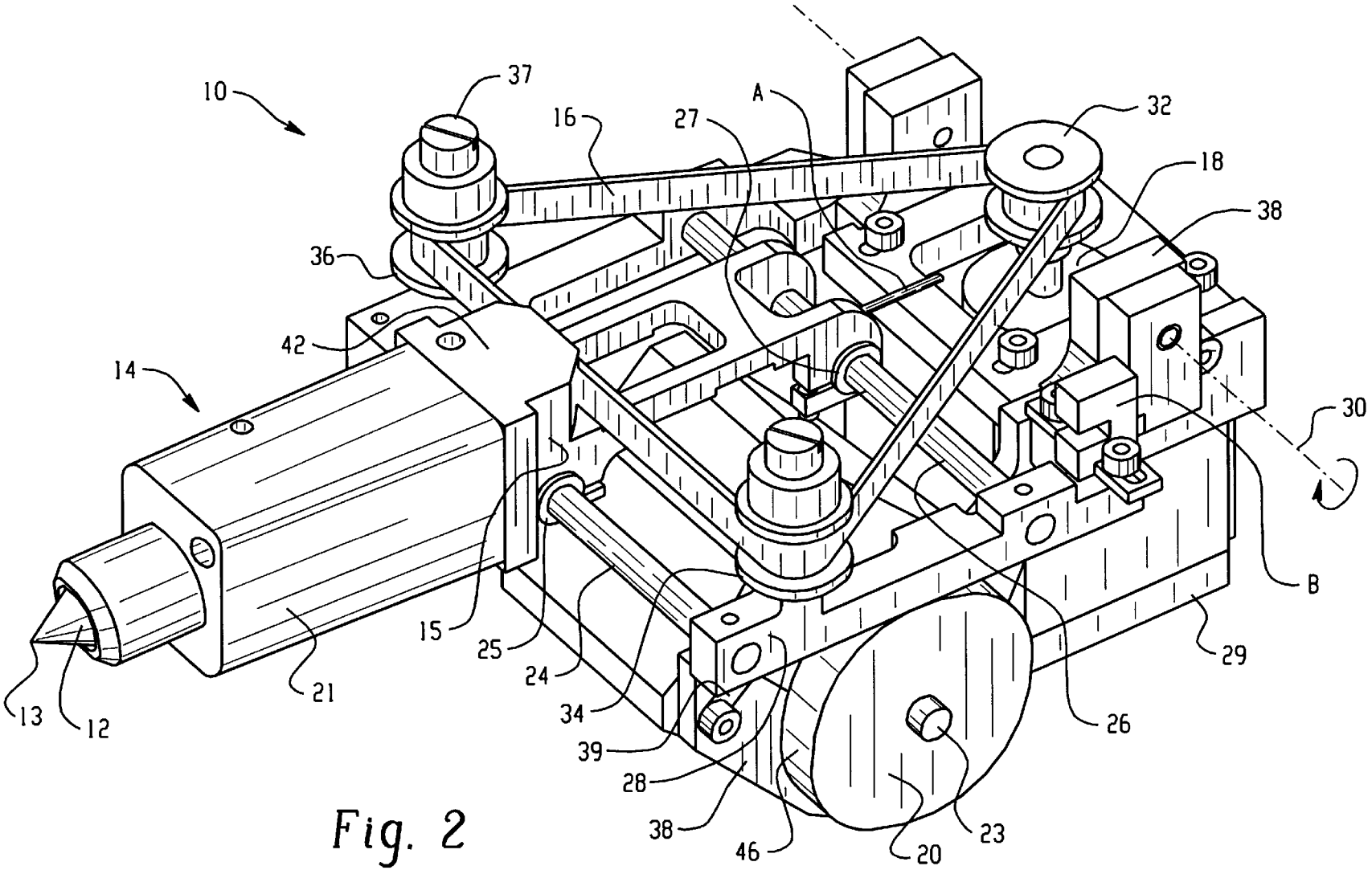
FIG. 2 is a front left side perspective view of the apparatus according to an embodiment of the invention.

Referring to FIGS. 1 and 2, the present invention is shown to include a single pin 12, dot peen marker, shown generally at 10. The single pin marking head assembly 14 is similar to that described in U.S. Pat. No. 5,368,400, issued to Cyphert et al., entitled "Marking Apparatus With Cable Drive", commonly assigned to the assignee of the present application and which is incorporated herein by reference. Marker 10 is commercially available as the Model TMP4100 from Telesis Technologies, Inc. of Circleville, Ohio and has the advantages of being simple, lightweight enough to be hand held, and constructed with compact, high resolution d.c. stepper motors 18, 22 which remain stationary during the marking sequence with respect to head assembly 14. By eliminating much of the mass generally associated with a traversing marking head, the speed of the d.c. stepping motors 18, 22, need not be ramped up and ramped down at the respective beginning and ending of a marking sequence. This decreases cycle time of the marking sequence, a much desired outcome.

Head assembly 14 is mounted to head mounting manifold 42 portion of head carriage 15. Head carriage 15 is fitted with a pair of armatures having bushings, as at 25 and 27, through which pass parallel guide rods 24 and 26. Guide rods 24, 26 are preferably fabricated from steel and are securely mounted in head drive frame 28.

In order to minimize weight of marker 10, head drive frame 28, head carriage 15 and base frame 29 are preferably fabricated from a lightweight, yet structurally rigid, material, such as aluminum. Head drive frame 28 is pivotally coupled to motor mount 38 along a pivot line 30 located at the midpoint of the X-axis capstan 32 mounted on the X-axis d.c. stepper motor 18. Capstan 32 is coupled to the X-axis d.c. stepper motor by motor shaft 19. Head drive frame 28 also supports two idler pulleys 34, 36 which are located in-line with the one edge of head carriage 15 so that drive belt 16 rides tangent to the idler pulleys and parallel to the motion of the head carriage. Idler pulleys 34 and 36, secured into place with idler retaining bolts 35 and 37, are preferably provided with teeth and are fabricated from suitable plastic material with metallic inserts (not shown). The tension on drive belt 16 is achieved by adjusting X-axis d.c. stepper motor 18 in relation to motor mount 38. Hence, drive frame pivot line 30 is designed to be close to the center of drive belt 16 to keep the drive frame 28 from being biased up or down (in the Y-axis) due to the tension of the drive belt.

Head assembly 14 is traversed horizontally in the X-axis by drive belt 16, which is driven by a X-axis d.c. stepper motor 18 in communication with control signals from a controller 70. The drive belt 16 is preferably provided with teeth and is fabricated from a fiber reinforced material to minimize stretching. Movement of drive from 28 in the X-axis provides horizontal articulation of marking pin 12 during a marking sequence.

The Y-axis d.c. stepper motor 22 is mounted on a motor mount 38 extending from and attached to the forward extent of base frame 29, which remains stationary in relation to drive frame 28 during operation. Motor mount 38 provides the stationary member from which drive frame 28 pivots along pivot line 30. Undulations of drive frame in the X-axis provides vertical articulation of marking pin 12 during a marking sequence.

The Y-axis d.c. stepper motor 22 is fitted with cam 20 mounted on the shaft 23 of the motor. Cam 20 is preferably made of long wearing plastic but may be fabricated from steel or other suitable materials as well. In one embodiment, cam 20 is fabricated from a plastic disk impregnated with TEFLON® or other low friction material to provide good wear resistance. Shaft 23 is located eccentrically from the center of cam 20 with a spring pin (not shown) mounted in the disk as a flag to be detected by a first optical sensor (not shown). Drive frame 28 rides on the outside circumference 46 of cam 20 at a known distance from the pivot line 30, thus providing a predetermined movement of head assembly 14 in the Y-axis when d.c. stepper motor 22 is actuated. Tension springs, such as at 39, or other biasing means are employed to maintain continuous contact between the circumferential surface 46 of cam 20 and the contacting point on the bottom side of drive frame 28.

Articulation of marking pin 12 in the Y-axis is a multiple of cam 20 offset calculated by the distance from frame pivot line 30 to indention tip 13, divided by the distance from frame pivot line point to the cam's outer diameter contact with drive frame 28. Movement of head assembly 14 in the X-axis is calculated by the pitch diameter of drive pulley 32 which is directly proportional to the movement of the head assembly.

Head assembly 14 is fitted with a mechanical flag (shown as A) that passes through a second optical sensor (shown as B) to find the "home" starting position of the X-axis.

Figure 3:
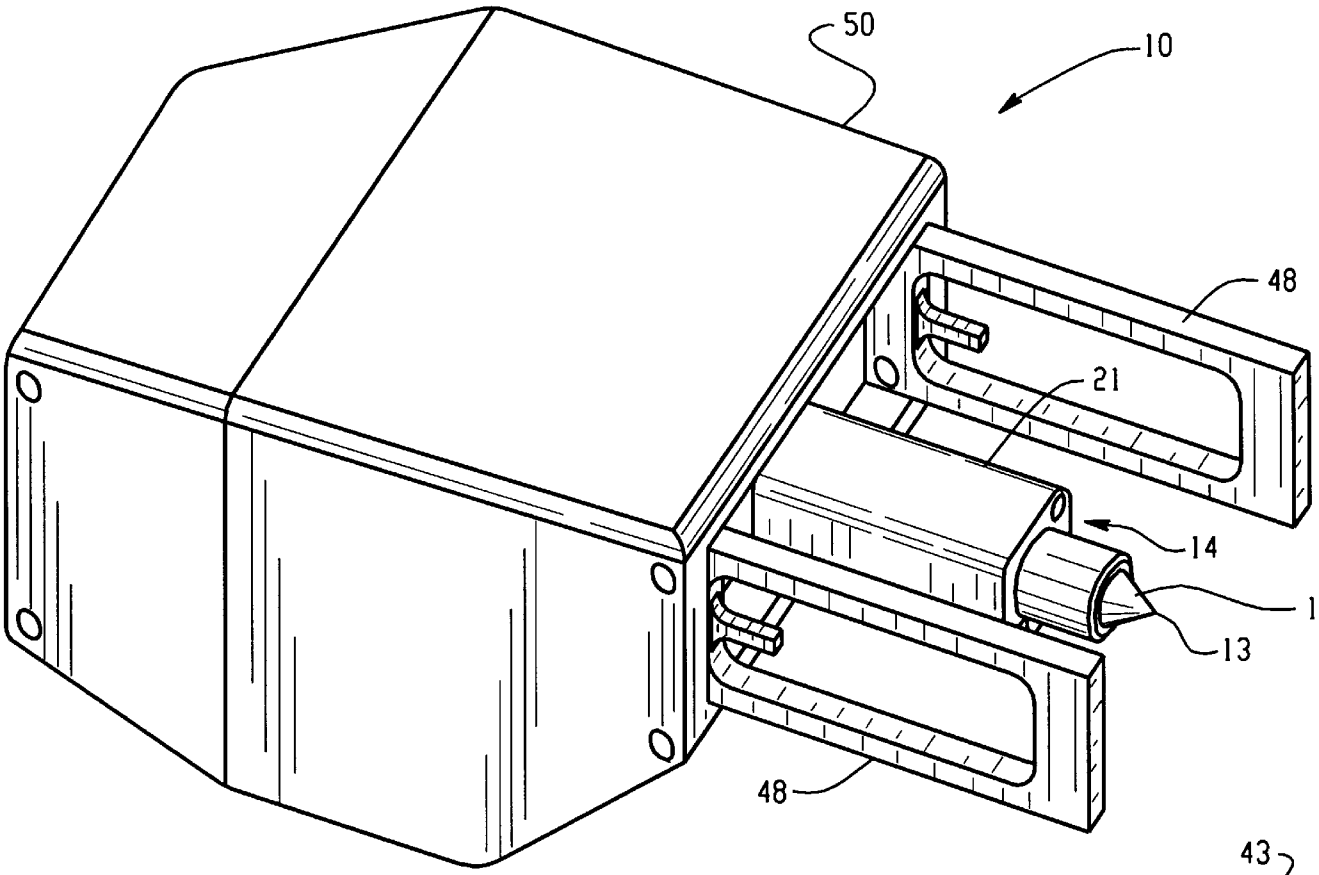
FIG. 3 is a front right side perspective view of an embodiment of the invention with an enclosure and standoff members shown.

Referring now to FIG. 3, marker 10 may be provided with standoffs, as at 48, for controlled placement and resting against the solid material surface being marked. Marker 10 preferably is provided with an enclosure 50 which protects the internal movements of frames 28 and 29 from damage or interference, as well as protecting the operator from physical exposure to the pinch points associated with moving components.

Figure 4A:
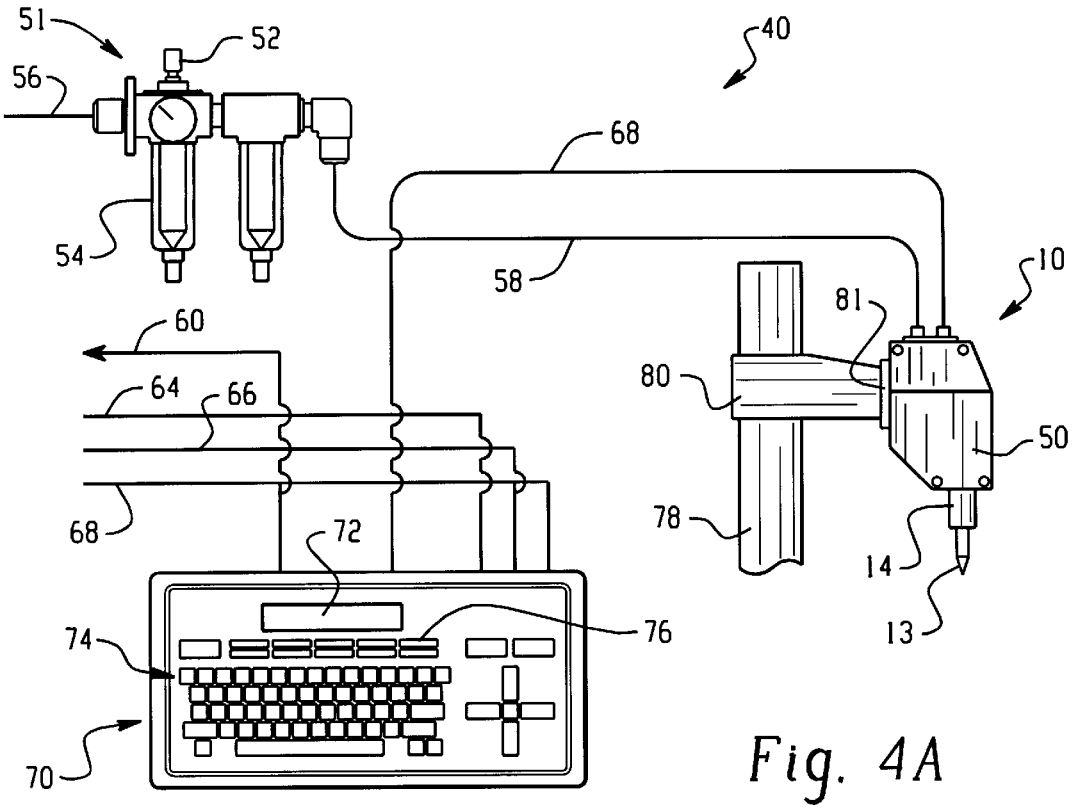
FIG. 4 is a block schematic of the marking apparatus of an embodiment of the invention shown with alternative mounting arrangements for the dot peen marker and in operative association with pneumatic and control inputs therefor.
Figure 4B:
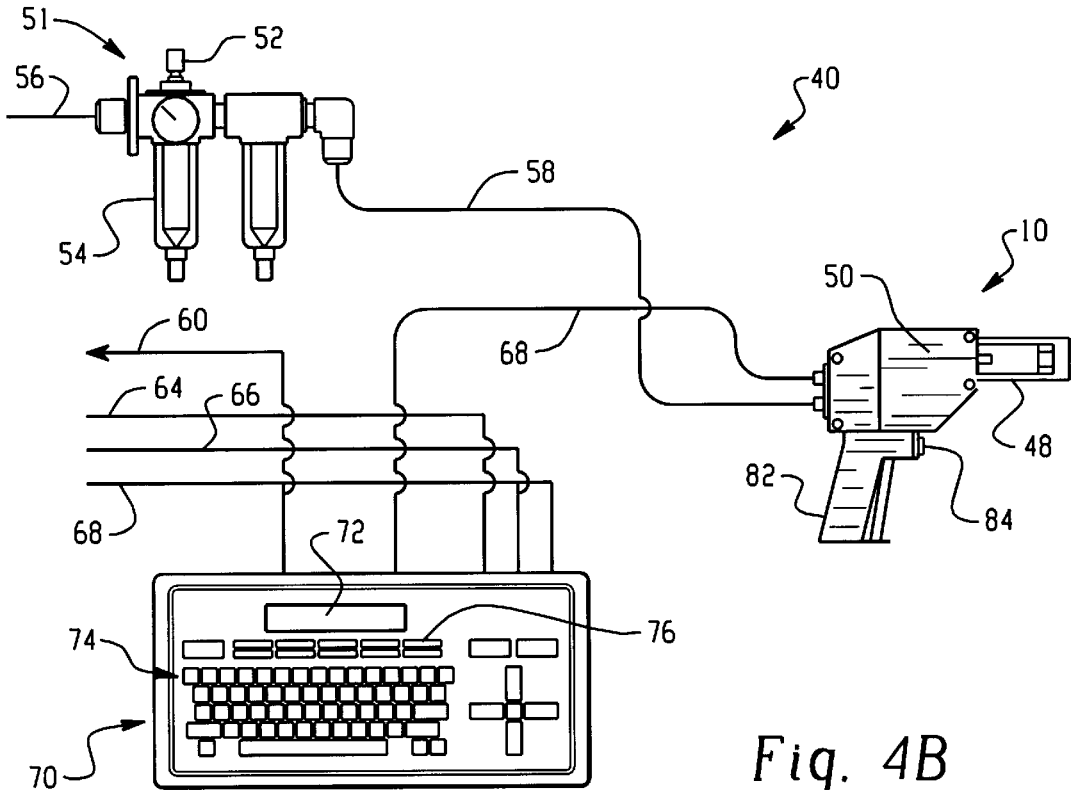

Referring next to FIG. 4, marker 10 is shown to be in communication with electronic controller 70 for controlling the actuation of system functions, such as the stepper motors 18, 22, the actuation and articulation of marking pin 12 and the storage of character strings to be applied by the marker. Controller 70 is generally microprocessor-based but may employ a microcontroller or other equivalent circuitry for monitoring and controlling the movement of head assembly 14 and sequencing of the marking pin 12. Marker 10 may be supplied with pneumatic controls, as well, should the unit be provided with air, rather than electric, solenoids as the driving force actuating marking pin 12. The use of electric and pneumatic controls in connection with single pin markers are known in the art, such as disclosed in U.S. Pat. No. 5,368,400, issued to Cyphert et al.

A schematic block view of a marking system in accordance with the present invention is revealed generally at 40 as including a marking apparatus 10, which is shown in a somewhat stylized fashion to be operably coupled with associated pneumatic and electrical control, as well as other inputs/outputs. Marker 10, which is noted to be of a compact and lightweight configuration, has a relatively small "footprint," and preferably includes a protective housing or other enclosure 50. At the rear of enclosure 50 are received the pneumatic and electromechanical control components via lines 58 and 68, through connections generally mounted on the body of the marker 10.

Marker 10 is shown in alternative applications, first as a fixed mounted marker mounted to a vertical stand 78, and secondly as a hand held unit with a gripping handle 82. In a fixed mounting arrangement, marker 10 may be provided with a mounting plate 81 affixed thereto. Mounting plate 81 may be connected to a mounting arm, as at 80, which in turn is moveably affixed to a stand 78 or other fixed platform. Preferably the fixed arrangement provides for adequate adjustment of the distance between head assembly 14 and the solid material surface being marked. In this manner, the size and quality of the indentations may be controlled. Although shown in a vertical orientation it should be understood that marker 10 may be configured to mark in a variety of different orientations except inverted, i.e., with the mounting plate 81 facing upward.

In the alternative configuration therein shown, marker 10 is fitted with a gripping handle 82 attached to its base frame 29. Gripping handle 82 is preferably fitted with a digitally-operable switch 84, in the form of a trigger, in electrical communication with controller 70 for selectively actuating a marking sequence of predetermined character strings. Exhaust ports from the pneumatically operable head assembly 14 may be channeled downwardly through gripping handle 82 in order to reduce the air noise generated by the marker 10 during operation.

For the operation of the noted marker 10 utilizing pneumatic components to provide the pin driving force, a source of air pressure 56 is supplied via a regulator unit, shown generally at 51, which may include one or more flow control valves, one of which is referenced at 52, and associated filters, one of which is referenced at 54. In the arrangement shown, facility air pressure is supplied to unit 51 via input pneumatic line 56, with regulated outputs to printer 10 being supplied via pneumatic line 58.

Similarly, electrical power for energization of the electromechanical system components may be provided via electrical line 60. Optionally, one or more external electrical connections may be provided via electrical lines 64 and 66 for remote input/output (I/O) signaling and other serial or parallel host interfacing communication via electrical line 68.

Lastly in connection with FIG. 4, a controller, represented at 70, may be provided for deriving control signals to be supplied to marker 10 via electrical line 68. Preferably, controller 70 includes an alphanumeric display, 72, which may be of either a liquid crystal (LCD) or a light emitting diode (LED) type. Readouts from display 72 may provide visible cues as operator prompts for the inputting of operational control parameters such as, for example, character fields, and also messages such as alerts to the operational status of the marker 10. Controller 70 may also include a manually-actuable keyboard, 74, having one or more predefined function keys, one of which is referenced at 76, for the direct operator selection of preprogrammed printing modes and other functions. As is conventional, controller 70 may operate under microprocessor-based control which utilizes, for example, integrated RAM for digital data storage and an EPROM for storage of firmware having microencoded data acquisition routines and computational algorithms.

Figure 5:
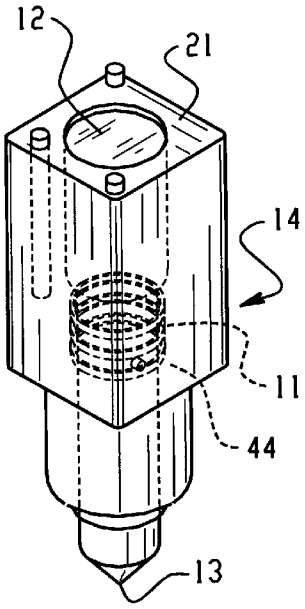
FIG. 5 is a perspective view of the marking head assembly and associated marking pin structure according to an embodiment of the invention.

Turning to FIG. 5, marking pin 12 is shown to be contained within a pin cartridge 21 of head assembly 14 which is mounted to the head carriage 15 by bolts (not shown) or other effective securing means. A return spring 11 in contact with cartridge seat 44 and the bottom of marking pin piston 43 is provided within the marking pin cartridge 21 to retract marking pin 12 to its top position when the driving force is removed. Alternately, as is known in the art, a return air pressure may be supplied to cartridge 21 at a point below the bottom of piston 43 effective for retracting marking pin 12 to its top position when drive air pressure is removed.

Figure 6:
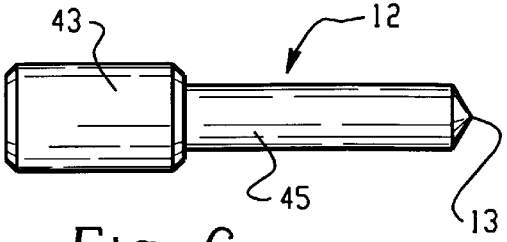
FIG. 6 is a side elevational view of the marking pin of one embodiment of the invention.

Looking now to FIG. 6, it is there revealed marking pin 12 having an upwardly disposed piston portion 43 which is necked down to provide a lower annular surface and having a shaft portion 45 extending to provide the conical indentation tip 13. Marking pin 12 is generally supplied as two different varieties, that is, fabricated from either powdered metal or carbide. While life of marking pin 12 will depend upon a number of factors such as the type of material being marked, how hard or abrasive it is, and the required marking depth, on typical surfaces, powdered metal pins average about 3 million impressions prior to needing sharpened. In contrast, carbide pins average around 9 million impressions under similar conditions but may increase marking cycle times due to the increased weight of the carbide material.

Head assembly 14 is seen having a confronting surface or edge through which the conical indentation tip 13 of marker pin protrudes. In one embodiment of the invention, head assembly 14 receives control actuated drive pneumatic inputs through head mounting manifold 42 from a valve controlled pneumatic assembly represented generally at 51 (FIG. 4).

In operation, the mechanical cycle of the present invention begins with both the X-axis and Y-axis going to their respective "home" positions. The X-axis d.c. stepper motor 18 is actuated until head carriage 15 moves to the left as viewed from behind and the Y-axis d.c. stepper motor 22 actuates cam 20 which rotates until the mechanical flag (not shown) passes through its respective optical sensor (not shown). Both axes always seek "home" in the same direction and at the same speed, the "home" position being in the same place regardless of any lost motion.

The information to be stamped (dot-matrix style) by marker 10 is entered and stored in controller 70. The information provided to the electronic controller is generally entered locally, as via a keypad or keyboard, but which may be entered remotely, via a parallel or serial data communications link 64, if controller 70 has been so configured. In operation, for a given character to be stamped, the controller 70 actuates X-axis d.c. stepper motor 18 to a predetermined, stored position in the X-axis and then signals the Y-axis d.c. stepper motor 22 to rotate a predetermined extent in the Y-axis, fires the air driven or electric solenoid (not shown), thus causing marking pin 12 to impinge the surface of the article being marked and leave a single indentation. Controller 70 then sequences the head assembly 14 to the next dot position, and once again triggers marking pin 12 with the configured driving force. This process continues until the desired message (comprised of characters, lines, logos or other graphics stored in the controller) have been applied to surface of the article. At the end of the stored message, controller 70 sends the head assembly 14 to a pre-designated "home" position, or a position, as selected by the operator, where it awaits for a control signal to begin its next marking cycle.

Since certain changes may be made in the above apparatus without departing from the scope of the invention herein involved, it is intended that all matter contained in the above description or shown in the accompanying drawings shall be interpreted as illustrative and not in a limiting sense.

I claim:

1. Apparatus mountable with a support structure for marking a solid material surface with predetermined character-based information in response to control signals, comprising:

a base frame;

a marking head drive frame having forward and rearward extents pivotally coupled at its rearward extent to said base frame;

first and second guide rods mounted in parallel adjacency at forward and rearward locations of said marking head drive frame;

a first motor assembly mounted to a motor mount, having a rotational output, and being coupled in driving relationship with a head carriage for effecting movement thereof in a first axis in response to said control signals;

a second motor assembly mounted to said motor mount, having a rotational output, and being coupled in driving relationship with said marking head drive frame for effecting movement thereof in a second axis in response to control signals;

a marking head carriage having forward and rearward bearing surfaces slidably engaged with said first and second guide rods and having a mounting head mounting component at its forwardmost extent;

a marking head assembly coupled with said marking head carriage, said marking head assembly having a confronting portion positionable a predetermined distance from said material surface, a marking pin chamber within said head assembly, said chamber having a drive portion extending from a top position toward a seating surface and communicating with a shaft receiving portion extending from said seating surface toward an opening at said confronting portion;

a marking pin positioned within said chamber having a piston portion of predetermined first diameter, movable by a driving force between a first position adjacent said top position and a second position toward said seating surface, and having a shaft portion of predetermined second diameter depending from said piston portion extending to an indentation tip;

a driving force configured to drive said marking pin with a force selected to form an indentation by said indentation tip in said solid material surface; and a biasing component within said assembly, actuable between said seating surface and said piston portion of said marking pin for urging said marking pin to return toward said top position when said driving force is removed.

2. The apparatus of claim 1 in which:

said first motor includes a toothed capstan rotatable as said rotational output in communication with a drive assembly, said drive assembly comprising first and second toothed idler pulleys, each being freely rotatable about their respective axes and being mounted upon said marking head drive frame at forward right and left most extents, and a drive belt having teeth corresponding to said teeth in said capstan and said idler pulleys, said belt having a predetermined length and being wound in driven relationship about said first motor capstan and extending about said first and second idler pulleys and being affixed to said marking head assembly for effecting movement of said marking head assembly in a first axis when said first motor is actuated; and said second motor includes a cam rotatable as said rotational output, said cam being mounted toward the front of said base frame and being in biased contact with said marking head drive frame for effecting movement of said marking head drive frame in a second axis when said second motor is actuated.

3. The apparatus of claim 2 in which said marking head drive frame is biased against said cam with at least one spring.

4. The apparatus of claim 1 wherein said head assembly is formed of polyetherimide material.

5. The apparatus of claim 1 in which said driving force is pneumatic pressure.

6. The apparatus of claim 5 wherein said pneumatic pressure is derived from a valve controlled pneumatic assembly providing substantially lubricant-free air.

7. The apparatus of claim 1 wherein said biasing component is a spring.

8. The apparatus of claim 1 wherein said biasing component is air pressure.

9. The apparatus of claim 1 wherein said head assembly comprises a electric solenoid and said driving force is electric.

10. The apparatus of claim 1 additionally comprising an enclosure.

11. A hand held marking apparatus for marking a solid material surface with predetermined character-based information in response to control signals, comprising:

a base frame;

a marking head drive frame having forward and rearward extents pivotally coupled at its rearward extent to said base frame;

first and second guide rods mounted in parallel adjacency at forward and rearward locations of said marking head drive frame;

a first motor assembly mounted to said base frame, having a rotational output, and being coupled in driving relationship with said head carriage for effecting movement thereof in a first axis in response to control signals;

a second motor assembly mounted to said base frame, having a rotational output, and being coupled in driving relationship with said marking head drive frame for effecting movement thereof in a second axis in response to control signals;

a marking head carriage having forward and rearward bearing surfaces slidably engaged with said first and second guide rods and having a mounting head mounting component at its forwardmost extent;

a marking head assembly coupled with said marking head carriage, said marking head assembly having a confronting portion positionable a predetermined distance from said material surface, a marking pin chamber within said head assembly, said chamber having a drive portion extending from a top position toward a seating surface and communicating with a shaft receiving portion extending from said seating surface toward an opening at said confronting portion;

at least one standoff having a predetermined length, extending from said base frame for contacting said material surface during marking for maintaining said confronting portion of said marking head assembly at a predetermined distance from said material surface;

a gripping handle connected to said base frame for manually positioning said marking apparatus with respect to said material surface and having a manually actuable switch in communication with said control signals for initiating a marking sequence;

a marking pin positioned within said chamber having a piston portion of predetermined first diameter, movable by a driving force between a first position adjacent said top position and a second position toward said seating surface, and having a shaft portion of predetermined second diameter depending from said piston portion extending to an indentation tip;

a driving force configured to drive said marking pin with a force selected to form an indentation by said indentation tip in said solid material surface; and a biasing component within said assembly, actuable between said seating surface and said piston portion of said marking pin for urging said marking pin to return toward said top position when said driving force is removed.

12. The apparatus of claim 11 in which:

said first motor includes a toothed capstan rotatable as said rotational output in communication with a drive assembly, said drive assembly comprising first and second toothed idler pulleys, each being freely rotatable about their respective axes and being mounted upon said marking head drive frame at forward right and left most extents, and a timing belt having teeth corresponding to said teeth in said capstan and said idler pulleys, said belt having a predetermined length and being wound in driven relationship about said first motor capstan and extending about said first and second idler pulleys and being affixed to said marking head assembly for effecting movement of said marking head assembly in a first axis when said first motor is actuated; and said second motor includes a cam rotatable as said rotational output, said cam being in biased contact with said marking head drive frame for effecting movement of said marking head drive frame in a second axis when said second motor is actuated.

13. The apparatus of claim 12 in which said marking head drive frame is biased against said cam with at least one spring.

14. The apparatus of claim 11 wherein said head assembly is formed of polyetherimide material.

15. The apparatus of claim 11 in which said driving force is pneumatic pressure.

16. The apparatus of claim 15 wherein said pneumatic pressure is derived from a valve controlled pneumatic assembly providing substantially lubricant-free air.

17. The apparatus of claim 12 wherein said biased contact is effected by at least one spring.

18. The apparatus of claim 11 wherein said biasing component is air pressure.

19. The apparatus of claim 11 wherein said head assembly comprises a electric solenoid and said driving force is electric.

20. The apparatus of claim 11 additionally comprising an enclosure.

* * * * *